United States Patent [19]

Kraft et al.

[11] 4,202,634

[45] * May 13, 1980

[54] RACK FOR VESSELS AND MEANS FOR AGITATING THE VESSELS IN THE RACK

[76] Inventors: Jack A. Kraft, 119 Elm La., New Hyde Park, N.Y. 11040; Harold D. Kraft, 147-14 70th Ave., Flushing, N.Y. 11367

[ * ] Notice: The portion of the term of this patent subsequent to Oct. 3, 1995, has been disclaimed.

[21] Appl. No.: 945,128

[22] Filed: Sep. 22, 1978

Related U.S. Application Data

[63] Continuation-in-part of Ser. No. 739,242, Nov. 5, 1976, Pat. No. 4,118,801.

[51] Int. Cl.[2] ..... B01F 11/00

[52] U.S. Cl. ..... 366/111; 366/114; 366/116; 366/128; 366/208

[58] Field of Search ..... 366/110, 111, 114, 116, 366/128, 208; 294/87.22, 87.24, 87.26; 233/26; 134/117, 137, 166 R; 211/74; 248/311.1

[56] References Cited

U.S. PATENT DOCUMENTS

| | | | |
|---|---|---|---|
| 856,619 | 6/1907 | Camp et al. | 366/214 |
| 2,345,130 | 3/1944 | Latham | 366/215 |
| 2,355,004 | 8/1944 | McCulloch | 294/87.24 |
| 2,360,978 | 10/1944 | Putter | 211/74 |
| 3,061,280 | 10/1962 | Kraft et al. | 366/110 |
| 3,159,384 | 12/1964 | Davis | 366/110 |
| 3,944,188 | 3/1976 | Parker et al. | 366/110 |
| 4,071,170 | 1/1978 | Gunzel, Jr. et al. | 366/128 |
| 4,118,801 | 10/1978 | Kraft et al. | 366/111 |

*Primary Examiner*—Harvey C. Hornsby
*Assistant Examiner*—Timothy F. Simone
*Attorney, Agent, or Firm*—Peter L. Berger

[57] ABSTRACT

A clamp means is provided for holding at least one vessel so that the vessel can be agitated by a drive means with the clamping means permitting the vessel to move with the clamping means defining the null point of the movement. The clamp means may provide a rack for resiliently clamping the vessel. Preferably, the clamping means is for resiliently clamping the vessel at a position remote from the bottom thereof. Drive means are provided for imparting motion, such as orbital motion, to the agitating means whereby fluent contents of the vessel are agitated. The apparatus is adapted for the holding and agitating a single or a plurality of vessels, such as a plurality of test tubes. The drive means also is capable of pulsing the orbital motion.

9 Claims, 9 Drawing Figures

RACK FOR VESSELS AND MEANS FOR AGITATING THE VESSELS IN THE RACK

This application is a Continuation-In-Part application of our earlier filed application Ser. No. 739,242, filed Nov. 5, 1976, U.S. Pat. No. 4,118,801.

BACKGROUND OF THE INVENTION

This invention relates to a clamp for holding at least one vessel for agitation of the vessel thereby to mix fluent contents of the vessel. The invention also relates to the combination of such a clamp with drive means for imparting such motion to the vessel or to vessels in a rack as to effect the agitation.

Many laboratories require the mixing of fluent materials in vessels such as test tubes. Manual agitation is tedious and time-consuming. Various mechanical agitators have, therefore, come into existence. Some do not thoroughly mix in a reasonable length of time the contents of a single vessel, because the contents vortex and form strata.

Further, these prior clamp devices fail to provide sufficient mechanical dynamics, so that when the tubes are agitated, the contents "spit" out.

A rack for simultaneously moving a plurality of vessels shown in our prior application Ser. No. 739,242. The orbiting mechanism causes the bottom portion of the holder containing the tubes to receive a quasi vertical motion causing some of the fluid contained in the test tubes to be ejected.

Another object of this invention is to provide a rack for simultaneously imparting orbital motion to a plurality of test tubes without vertical motion being imparted thereto.

Another object of the present invention is to provide a drive mechanism which enables various types of movements to be accommodated in the driving portion of the rack without shearing the members under strain during said movement.

Still another object of the present invention is to provide a drive means for the clamp vessel where the drive means includes a means to pulse the motor providing the orbital movement so as to enhance the mixing and minimize stratification in the vessel.

Other objects and advantages of the invention will be apparent to one skilled in the art from the following description of the invention.

SUMMARY OF THE INVENTION

According to one aspect of the invention, there is provided a clamp for holding at least one vessel for agitation of the vessel, the clamp comprising means for resiliently clamping the vessel, the clamping means permitting the vessel to move with the clamping means and with the vessel defining the null point of the movement. The clamping means resiliently clamps the vessel at a position remote from the bottoms thereof and laterally movable agitating means is provided for engaging the vessel near the bottom thereof.

More particularly, the clamp may be part of a rack which may comprise a frame and the clamping means may comprise a pair of opposed clamping members each having a resilient edge facing a resilient edge of the other clamping member, means laterally shiftably supporting the clamping members in the frame and means for laterally shifting at least one of the members between positions in which the clamping members do not clamp a vessel received therebetween and positions in which the clamping members are sufficiently close to each other so that they resiliently clamp a vessel received therebetween.

In an arrangement particularly well adapted for the holding of a plurality of vessels, such as test tubes, the clamping means comprises three clamping members. A first of the clamping members is arranged in the frame between the second and third clamping members. The first clamping member has a respective resilient edge at each of two opposite sides thereof, the second clamping member has a resilient edge facing one of the resilient edges of the first clamping member and the third clamping member has a resilient edge facing the other resilient edge of the first clamping member. The lateral shifting means comprises means for laterally shifting the second and third clamping members between positions sufficiently spaced from the first clamping member so that a vessel received between the first and the second or between the first and the third clamping members is not clamped therebetween and positions in which the clamping members are sufficiently close to each other that a vessel received between the first and the second or between the first and the third clamping members is clamped therebetween.

In a particularly effective arrangement for providing secure clamping according to the invention, the clamping means comprises a shaft, handle means rigidly mounted on the shaft for facilitating manual rotation of the shaft, a crossbar rigidly mounted on the shaft, first and second level arms each pivotally connected near one end to the crossbar at a point near a respective end of the crossbar and each pivotally connected near the other end to a respective one of the second and third clamping members. One of the lever arms extends upwardly from the crossbar and the other lever arm extends downwardly from the crossbar. A vessel received between the first and the second or between the first and the third clamping members is clamped therebetween when the shaft is rotated sufficiently that a line connecting the points of pivotal connection of the lever arms to the crossbar has rotated from an orientation non-parallel in a first rotational sense to a plane common to the resilient edges of the second and third clamping members to an orientation non-parallel in a second rotational sense to the aforementioned common plane.

The agitating means may comprise a platform having recesses formed therein each for receiving a respective vessel. The platform may be connected to the frame by a plurality of resilient posts, the posts permitting lateral movement of the platform. Coupling means may be formed on the platform for engagement with means for driving the platform.

According to another aspect of the invention, there is provided a drive means for imparting motion to the agitating means. The drive means may comprise a frame, a platform, a plurality of resilient posts connecting the platform to the frame, a crank and a motor having a rotationally driven shaft, the motor shaft being connected to one end of the crank for driving the crank and the platform being connected to the other end of the crank, whereby rotation of the motor shaft imparts orbital motion to the platform. Means may be provided for releasably coupling the drive means platform and the rack platform so that the rack platform moves with the drive means platform. In particular, the coupling means may comprise bosses formed on the upper surface of the drive means platform and recesses formed in the lower surface of the rack platform for receiving the bosses.

It has further been found that the drive means platform should contact the lower surface of the rack platform during the orbiting movement in order to eliminate vertical motion being imparted to the rack. This is provided in the instant invention by placing the rack bottom directly on the orbiting drive of the base to make contact therewith.

The apparatus may also comprise means for releasably connecting the frame of the rack to the frame of the drive means whereby the frames remain stationary while motion is imparted to the platforms. The connecting means may comprise bosses on the bottom of the rack frame and members rigidly connected to the frame of the drive means and having recesses formed therein for receiving the bosses on the bottom of the rack frame.

DESCRIPTION OF A PREFERRED EMBODIMENT

The invention will now be further described by reference to a specific, preferred embodiment, as illustrated in the drawings, in which.

Figure 1:
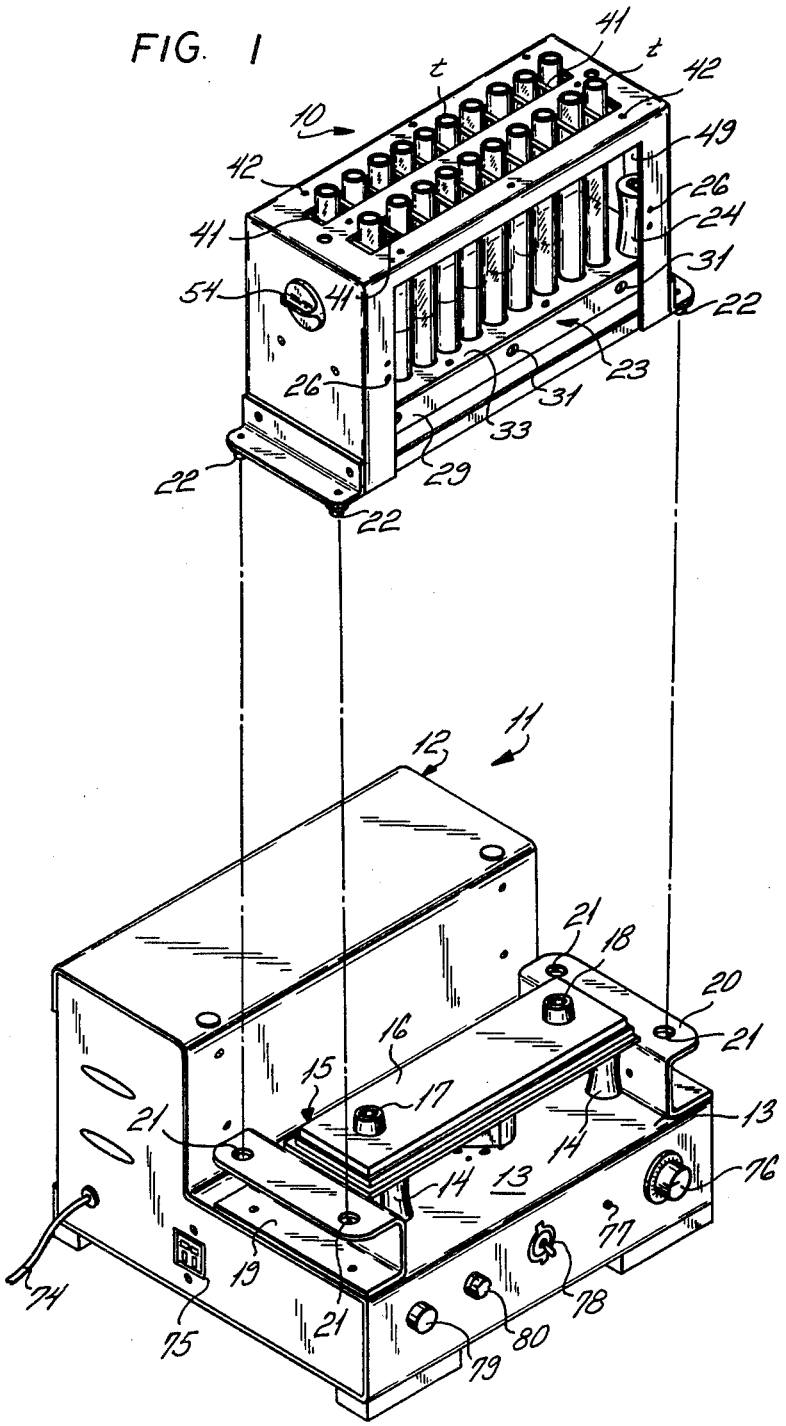
FIG. 1 is an exploded isometric view of the combination of a rack and drive means according to the invention.
Figure 2:
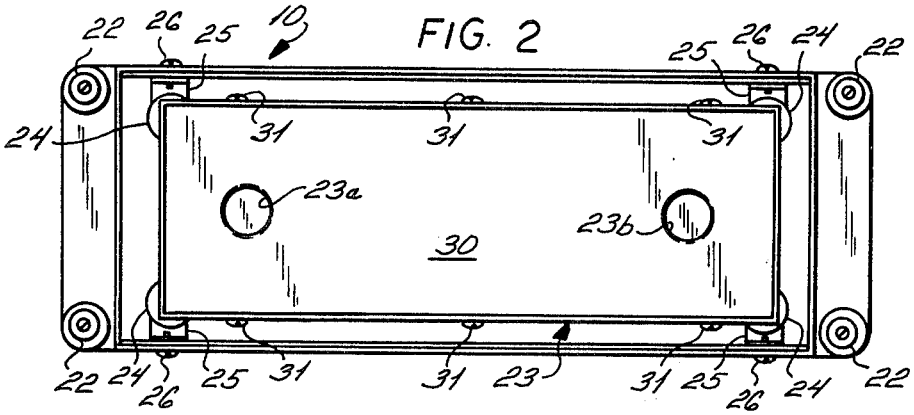
FIG. 2 is a plan view of the bottom of the rack.

The apparatus of FIG. 1 is comprised of a rack 10 and a drive means or base 11. The particular rack illustrated in FIG. 1 has a capacity of twenty test tubes, t, which are illustrated clamped in place in FIG. 1. The frame of the drive means is a sheet metal box 12. Mounted on the front top portion 13 of the box 12 by means of four resilient rubber posts 14 at the corners is a platform 15. The top 16 of the platform 15 is a rubber pad on which are fastened two bosses 17 and 18. Alongside the platform 15, respective channel members 19 and 20 are fastened to the front top portion 13 of the box 12. Each channel member 19 and 20 is provided with a pair of apertures 21 which are sized and located to receive rubber bosses 22 provided at the corners of the bottom of the rack 10. The bosses 22 also serve as feet for the resting of the rack 10 on a surface when the rack 10 is not mounted on the drive means 11. The rack 10 is provided with a platform 23 and formed in the underside of the platform 23 are holes **23*a* and 23*b* (FIG. 2) for receiving the bosses 17 and 18 whereby the platform 23 may be coupled to the platform 15**.

Figure 3:
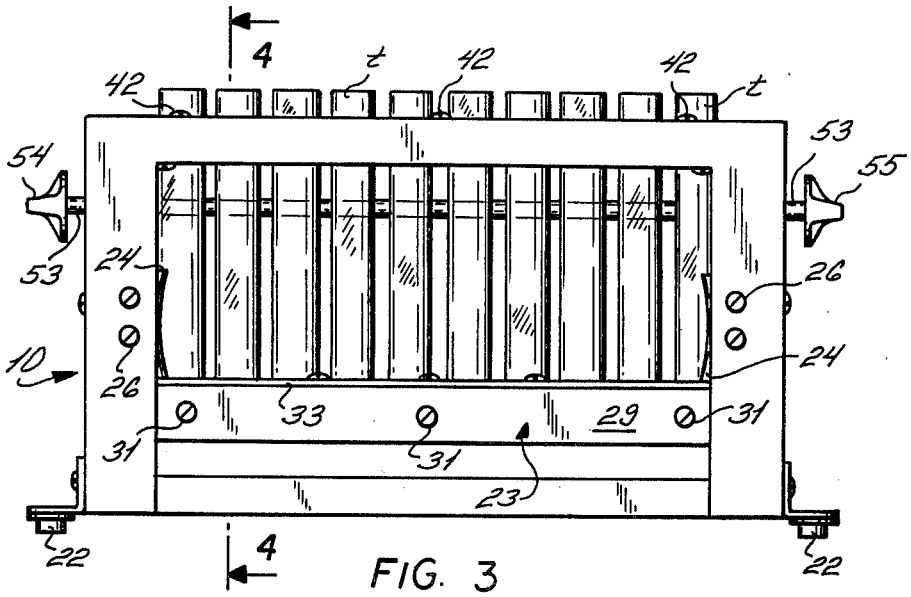
FIG. 3 is a front elevation of the rack with test tubes clamped in place.
Figure 4:
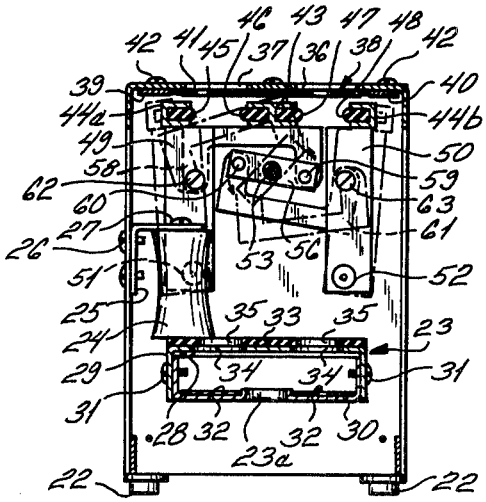
FIG. 4 is a section taken on section line 4—4 of FIG. 3, with the test tubes and one of the resilient posts omitted for clarity of illustration.

The platform 23 of the rack 10 is suspended from the sheet metal framework of the rack 10 by means of resilient rubber posts 24 fastened to the corners of the platform 23 (FIGS. 3 and 4). Each of the posts 24 is fastened to the frame of the rack by means of a respective bracket 25. Each bracket 25 is fastened to the frame of the rack by means of screws 26. A screw 27 fastens the resilient rubber post 24 to the bracket 25. A second, like screw 28 fastens the platform 23 to the post 24.

The platform 23 is fabricated of two sheet metal sections 29 and 30 having bent edges, the sheet metal sections 29 and 30 being fastened together by means of screws 31. The interior bottom surface of the section 30 is lined with a rubber sheet 32 through which the holes **23*a* and 23*b* extend as well as through the section 30. A rubber sheet 33 is fastened to the topmost surface of the platform 23. Circular apertures 34 are provided through the top of the section 29 and, axially aligned therewith, slightly smaller circular apertures 35 are provided through the rubber sheet 33. The number of respective apertures 34 and 35, namely, 20, corresponds to the test tube capacity of the rack 10**.

Figure 5:
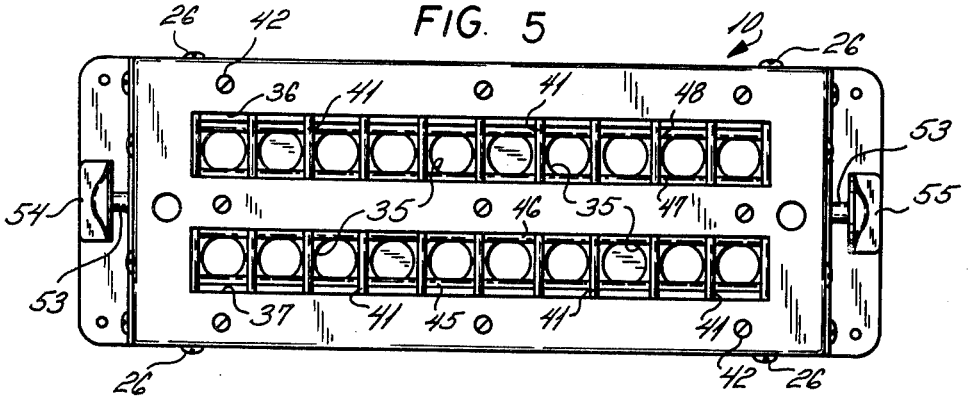
FIG. 5 is a plan view of the rack from the top.

A pair of elongated rectangular openings 36 and 37 is provided through the top of the frame of the rack 10 (FIG. 5). A spacer framework 38 having side rails 39 and 40 and crossrods 41 is fastened to the frame of the rack 10 by means of screws 42, which are received in tapped holes in the side rails 39 and 40.

Also associated with the frame of the rack 10 are three clamping members 43, **44*a* and 44*b*. The clamping members 44*a* and 44*b* are in the form of single-channels and the clamping member 43 is in the form of a double-channel. Respective lengths of rubber tubing 45, 46, 47 and 48 are pinched in the channels of the clamping members 44*a*, 43 and 44*b* (FIG. 4). The clamping member 43 is fastened to the frame of the rack 10 by means of screws. The clamping members 44*a* and 44*b* are laterally shiftably supported in a manner which will hereinafter be described. In particular, the arrangement is illustrated in FIG. 4. It is to be understood that a like arrangement is found at the other end of the rack 10**.

With reference to FIG. 4, it is seen that the clamping member **44*a* is fastened to the end of a lever arm 49 and the clamping member 44*b* is fastened to the end of a lever arm 50. The lever arm 49 is pivotally connected to an end wall of the frame of the rack 10 by means of a pivot pin 51 and the lever arm 50 is similarly pivotally mounted by means of a pivot pin 52. A shaft 53 extends the full length of the frame of the rack 10 (FIG. 3) and is rotatably supported in the end walls of the frame of the rack 10. Handles 54 and 55 are provided at the ends of the shaft 53 to facilitate manual turning of the shaft 53 (FIG. 3). A crossbar 56 is fixed to the shaft 53. A lever arm 58 is pivotally connected near one end thereof by means of a pivot pin 59 to the crossbar 56 near one end of the crossbar 56. The lever arm 58 extends upwardly from the crossbar 56. Also pivotally connected to the crossbar 56, near the other end thereof, by means of a pivot pin 60, is a lever arm 61 which extends downwardly from the crossbar 56. The other end of the lever arm 58 is pivotally connected to the lever arm 49 by means of a pivot pin 62, and the other end of the lever arm 61 is connected to the lever arm 50 by means of a pivot pin 63**.

In FIG. 4 the mechanism is illustrated in solid lines in a position in which the test tubes are clamped and in phantom in a position in which the test tubes are released. Hence, as viewed in FIG. 4, clamping of the test tubes requires clockwise turning of the shaft 53 and unclamping of the test tubes requires counterclockwise turning of the shaft 53.

The mechanism illustrated in FIG. 4 not only closes the clamping means but also locks the clamping means.

As the shaft 53 is rotated clockwise (as viewed in FIG. 4) from a position in which the clamps are open to a position in which the clamps are closed, the clockwise rotation of the crossbar 56 causes the lever arms 58 and 61 to pull the lever arms 49 and 50, and therewith the clamping members 42 and 44, toward each other. The test tubes are then clamped between opposed pairs of resilient rubber tubes 45 and 46, as one pair, and 47 and 48, as the other pair. Imagining a horizontal plane passing through the centers of the tubes 45 and 48 and an imaginary line extending along the crossbar 56 from the center of the pivot pin 59 to the center of the pivot pin 60, it is seen that in the rotating of the crossbar 56 from a position in which the clamping members are open to a position in which the clamping members are closed, the imaginary line has rotated from an orientation non-parallel in a first rotational sense to the imaginary plane to an orientation non-parallel in a second rotational sense to the imaginary plane. This means that lateral forces applied to the clamping members 42 and 44 will apply a clockwise torque to the shaft 53 whereby the clamping members will not gradually open due to the lateral forces applied thereto by the test tubes. The resilient tubular sections 45, 46, 47 and 48 prevent the clamping members from damaging the test tubes. The cross rods 41 are sheathed with resilient plastic or rubber to prevent any possibility of damage to the test tubes by the cross rods 41.

The bottoms of the test tubes are received in the openings 35 in the rubber sheet 33 and the openings 34 in the sheet metal section 29 and rest on the rubber sheet 32. Because the diameter of the holes 35 is somewhat less than the diameter of the holes 34, the portion of each test tube which passes through the holes 34 and 35 is contacted only by rubber. Similarly, the very bottom of the test tube is contacted only by the rubber sheet 32. The possibility of breakage of the test tubes is, thus, minimized.

The suspending of the platform 23 from resilient posts 24 makes possible the imparting of lateral motion to the platform 23 for the purpose of agitating the test tubes and, thereby, mixing fluent contents of the test tubes. The flexibility of the resilient tubes 45, 46, 47 and 48 permits the test tubes to move in response to lateral forces applied by the edges of the holes 35 without breaking.

Figure 6:
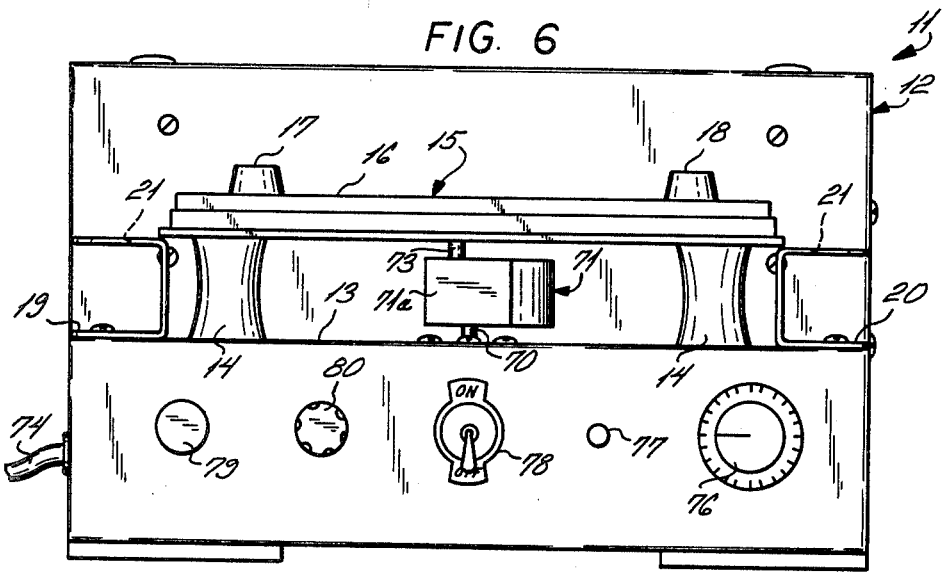
FIG. 6 is a front elevation of the drive means.
Figure 7:
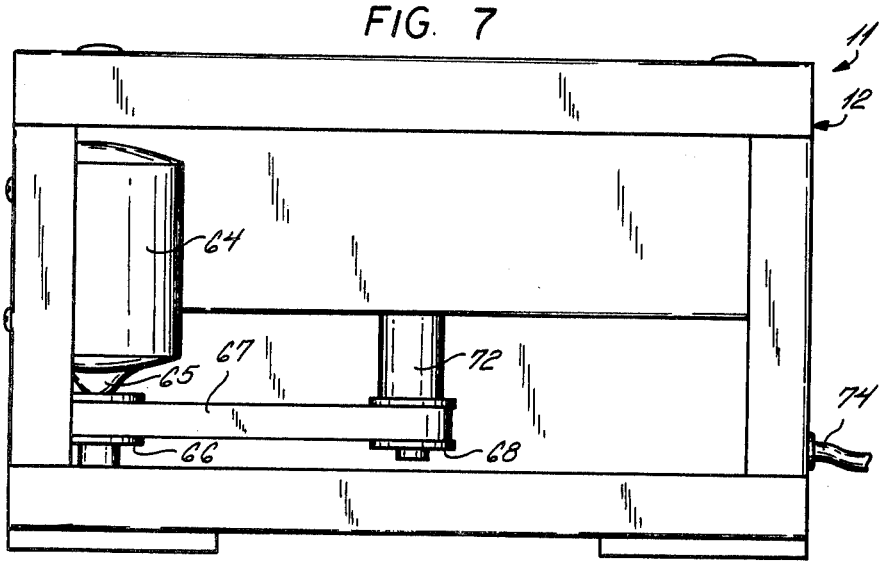
FIG. 7 is a back elevation of the drive means.

It can readily be seen that mounting of the rack 10 on the driving means 11 in the manner hereinabove described results in the frame of the rack 10 being fixedly connected to the frame of the driving means 11 while the platform 23 of the rack 10 is movable with the platform 15 of the driving means 11. When there is prolonged movement of the rack, the rack 10 may be fixedly secured to the base or box 12 by means of a conventional C-clamp (not shown) between the lip holding bosses 22 and the upper portion of channel members 19 and 20. With reference to FIGS. 6 and 7, it is seen that the drive train for the platform 15 consists of an electric motor 64 having a drive shaft 65 mounting a timing pulley 66 connected by means of a timing belt 67 to a timing pulley 68, the timing pulley 68 being connected to an arm 70 of an eccentric 71, the arm 70 is being rotatably mounted in a bearing 72. The other arm 73 of the eccentric 71 is pivotally connected to the platform 15. Consequently, actuation of the motor 64 results in an orbital motion being imparted to the platform 15 and, therefore, to the platform 23. Agitation of the clamped test tubes and consequent mixing of the fluent thereof result.

In accordance with the principles of this invention, platform 15 is adapted to contact platform 23 of the rack. This contacting between platforms 15 and 23 takes place during the orbiting movement of the orbiting drive. Such contact between the platform of the rack and drive platform prevents vertical motion being imparted to the vessels or tubes to avoid spilling out of the liquids containined within the tubes during orbiting motion. Previously, it had been found that in some instances, the orbiting movement caused a partial vertical motion to be imparted to the test tubes, and such movement resulted in the ejection of liquid therefrom. As a consequence, and as set forth above, contact is now provided between the platforms to eliminate such vertical movement.

Figure 8:
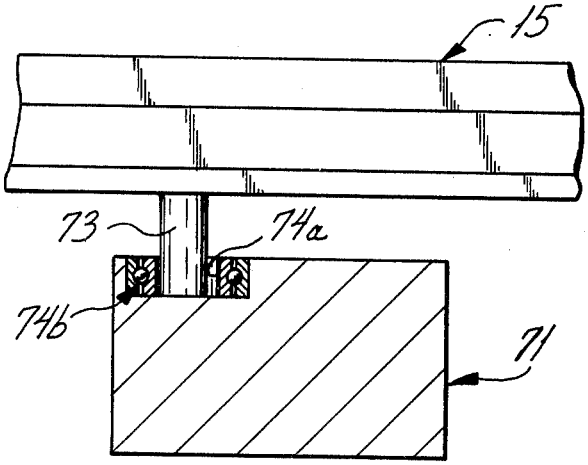
FIG. 8 is a partial sectional view of eccentric 71 of FIG. 6 illustrating the orbital movement imparted to the platform 15.
Figure 9:
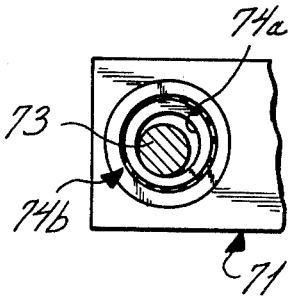
FIG. 9 is a top view of the driving mechanism illustrated in FIG. 8.

FIG. 8 is a partial sectional view of eccentric 71 illustrating another embodiment and improvement of the present invention. When the base drive pin 73 receives eccentric movement through the movement of eccentric 71, significant stress is imparted to pin 73. In order to minimize end thrust effects on the bearing 72, (see FIG. 7), due to dimensional tolerances and/or compression or expansion of the flexible support posts 14 on platform 15, a loose fit is provided between pin 73 and an inner race **74*a* of a bearing 74*b*. Bearing 74*b* is adapted to cooperate with loosely fitting pin 73 in order to impart the orbiting motion of eccentric 71 to platform 15. This is accomplished by off-setting bearing 74*b* with respect to shaft 70, and although the upper pin 73 loosely fits within the bearing 74*b*, the offset relationship between shaft 70 and bearing 74*b* permits a continual contact between pin 73 and bearing 74*b*** to impart the orbiting motion of the base to the rack platform.

A power cord 74 for plugging into an outlet is, of course, provided. Also, a socket 75 for remote control of the apparatus is provided. The motor drive is controlled by an electronic solid state variable speed control 76. A pilot light 77 is provided to indicate an "on" condition of the apparatus. An off-on toggle switch 78 and a momentary push-button switch 79 are included in the circuitry to ease the machine operation under various conditions. The front panel also includes a switch 80 which actuates conventional electronic means for actuating the motor in pulses. It has been found that pulsed driving of the agitating means facilitates homogeneous mixing in that stratification in the vessel is avoided. Conventional electronic means for accomplishing such pulsing, optional with conventional means for adjusting the period of the pulses, may be included in the circuitry of the apparatus.

The pulsing of the orbiting platform is accomplished by bearing the drive through variable speed control 76. It has been found that by varying the speed of the motor within a 10% plus or minus variation from the selected operating motor speed, minimization of stratification takes place. Thus, in operating the orbiting platform, the motor speed can be set to vary within a 20% speed range in order to accomplish the above-said minimization of stratification. It may be preferable to use a motor having a normal operating speed and achieve variable speeds by turning the motor on and off. Further, braking means could be employed to vary the motor speed.

It may thus be seen that the present invention provides a unique apparatus for resiliently clamping a vessel at the upper portion thereof with a null point formed between the vessel and clamp, so that during orbital movement imparted to the lower portion of the vessel, the liquid contained within the vessel at the null point will spin but not move above it. The maintenance of the null point along the vertical center line of the vessel at the point of the clamp enables compensating movement to be obtained when the vessel is moved in any direction and held by the resilient clamping means. The resilient clamping means provides an equal radial force imparted to the vessel at the clamp position, with such equal force providing the compensating holding action so that the vessels can orbital move along the bottom without altering the null point formed between the clamp and vessel. As such, the true null point is maintained while the orbiting action takes place, and this action is a significant improvement over that of the prior art, especially with regard to preventing the accidental spillage of the liquid contained within the vessel during the orbital movement.

While the invention has been described with reference to a specific, preferred embodiment, it will be understood that modifications and variations obvious to one skilled in the art are intended to be encompassed within the scope of the invention as defined by the hereto appended claims. For example, motions other than orbital, such as reciprocal, may be imparted to the platform.

What is claimed is:

1. A clamp for holding a vessel while the bottom of said vessel is subjected to an orbital movement, to spin liquid contained within said vessel, said apparatus comprising a support member engaging the vessel at an upper portion thereof, said support member comprising a resilient collar comprising a rubbery material to frictionally engage and hold said vessel in said collar while the bottom of said vessel receives said orbital movement, said rubbery material of said resilient collar frictionally engaging said vessel and comprising yieldable characteristics permitting the bottom of the vessel to receive an orbital movement while said vessel is held within said resilient collar, said liquid being spun under influence of said orbital movement, said support member and said vessel being arranged to define a null point of movement of said vessel to be centered within the region defined by said resilient collar to prevent spillage of the liquid contained in the vessel while being spun during said orbital movement.

2. A clamp according to claim 1, comprising a frame, said collar comprising a pair of opposed clamping members each having a resilient edge, means laterally shiftably supporting the clamping members in the frame and means for laterally shifting at least one of the members between positions in which the clamping members are sufficiently spaced so that the clamping members do not clamp a vessel received therebetween and positions in which the clamping members are sufficiently close to each other so that they resiliently clamp a vessel received therebetween.

3. A clamp according to claim 2, comprising drive means for providing orbital movement which comprises a drive motor and an eccentric driven thereby, a drive platform having a pin depending therefrom, said eccentric including a bearing in which said pin moves, such that the movement of said eccentric is imparted to said drive platform through said pin and bearing to impart orbital movement to the bottom of said vessel.

4. A clamp according to claim 3, wherein said pin loosely fits within said bearing, said bearing having an inner race with said pin bearing against said inner race, said bearing being offset with respect to said drive means.

5. A clamp according to claim 1, comprising means for pulsing said vessel to break up strata formed in said vessel as it is being spun.

6. A clamp according to claim 5, wherein said means for pulsing the said vessel comprises a motor having its speed varied.

7. A combination according to claim 6, wherein said motor speed varies plus or minus 10% from the normal motor speed utilized for said orbiting movement.

8. A clamp according to claim 1, further comprising a resilient material located at the bottom of said vessel with said vessel resting thereon, said resilient material minimizing ejection of liquid from said vessel.

9. Mixing apparatus for mixing liquid in a vessel comprising drive means to orbitally drive the bottom of a vessel to create a spinning action of said liquid in said vessel, said vessel being vertically held in place and being capable of remaining vertically in place while said bottom of said vessel receives said orbital motions, means for supporting said vessel to form a null point of movement of said liquid within said vessel to prevent spillage of said liquid and means to discretely change the speed of orbital movement of said vessel and to impart a pulsing motion to said vessel to break up strata formed in said vessel as it receives said orbital movement.

* * * * *